US007380397B2

(12) United States Patent
Chang

(10) Patent No.: US 7,380,397 B2
(45) Date of Patent: Jun. 3, 2008

(54) AUTOMOBILE EXHAUST PIPE ASSEMBLY

(76) Inventor: Chih-Kuang Chang, P.O. Box 36-80, Taichung City (TW)

( * ) Notice: Subject to any disclaimer, the term of this patent is extended or adjusted under 35 U.S.C. 154(b) by 330 days.

(21) Appl. No.: 11/223,196

(22) Filed: Sep. 8, 2005

(65) Prior Publication Data

US 2007/0051557 A1 Mar. 8, 2007

(51) Int. Cl.

| | |
|---|---|
| ***F01N 7/00*** | (2006.01) |
| ***F01N 1/00*** | (2006.01) |
| ***F01N 7/08*** | (2006.01) |
| ***F01N 1/02*** | (2006.01) |
| ***F01N 1/10*** | (2006.01) |

(52) U.S. Cl. ..... 60/324; 181/247; 181/248; 181/249; 181/252; 181/256

(58) Field of Classification Search ..... 181/247, 181/248, 249, 252, 256; 60/324, 299
See application file for complete search history.

(56) References Cited

U.S. PATENT DOCUMENTS

| | | | | |
|---|---|---|---|---|
| 2,035,500 | A * | 3/1936 | Nulty | 181/247 |
| 2,075,088 | A * | 3/1937 | Blanchard | 181/247 |
| 2,512,155 | A * | 6/1950 | Hill | 181/249 |
| 4,690,245 | A * | 9/1987 | Gregorich et al. | 181/272 |
| 5,371,331 | A * | 12/1994 | Wall | 181/227 |
| 5,426,269 | A * | 6/1995 | Wagner et al. | 181/232 |
| 5,892,186 | A * | 4/1999 | Flugger | 181/252 |
| 5,902,970 | A * | 5/1999 | Ferri | 181/249 |
| 6,158,546 | A * | 12/2000 | Hanson et al. | 181/255 |
| 2005/0161283 | A1 * | 7/2005 | Emler | 181/249 |
| 2005/0223703 | A1 * | 10/2005 | Wagner et al. | 60/324 |

* cited by examiner

*Primary Examiner*—Thomas E. Denion
*Assistant Examiner*—Loren Edwards
(74) *Attorney, Agent, or Firm*—Charles E. Baxley

(57) ABSTRACT

The present invention describes an automobile exhaust pipes, and more particularly to an exhaust pipe capable of producing appropriate pressure to assist engine torque output when the engine is running at a low speed and expediting the waste gas to be discharged from an automobile when the engine is running at a high speed, so as to enhance the operating performance of automobile engines.

4 Claims, 7 Drawing Sheets

AUTOMOBILE EXHAUST PIPE ASSEMBLY

BACKGROUND OF THE INVENTION

1. Field of the Invention

The present invention generally relates to automobile exhaust pipes, and more particularly to an exhaust pipe capable of producing appropriate pressure to assist engine torque output when the engine is running at a low speed and expediting the waste gas to be discharged from an automobile when the engine is running at a high speed, so as to enhance the operating performance of automobile engines.

2. Description of the Related Art

In the operating principle of an automobile, an engine nebulizes a fuel and mixes the nebulized fuel with air, so as to create an explosion in a cylinder, and the pressure of expansion is converted into a rotary force to drive the wheels to rotate. The mainstream of automobiles is a 4-cylinder engine with a design of driving the pistons repeatedly to move up and down for two times. In other words, four actions including an air inhaling, a compression, an expansion, and a discharge are preformed when the engine rotates twice, and the ignition is done by electric sparks. The total volume for the pistons in the cylinders to move up and down is called exhaustion capacity, which is also an index of an engine power. In normal conditions, if the engine is running at a low speed, then the exhaust pipe will produce an appropriate discharge pressure to assist the engine torque output; and if the engine is running at a high speed, the exhaust pipe will expedite the exhaustion to enhance the engine operating performance of an automobile.

SUMMARY OF THE INVENTION

The primary objective of the present invention is to provide an appropriate pressure to assist a low-speed torque output when the engine is running at a low speed and automatically and quickly discharge the waste gas from the exhaust pipe in split flows when the engine is running at a high speed, so as to enhance the engine operating performance. The present invention can meet both of the high-speed and low-speed requirements of an exhaust pipe.

Another objective of the present invention is to achieve the effect of lowering the noise of the exhaustion, in addition to meeting the high-speed and low-speed requirements of the exhaust pipe.

To achieve the foregoing objective, an automobile exhaust pipe assembly in accordance with the present invention comprises:

an internal pipe, having linearly corresponding first end and second end, respectively having a plurality of overflow holes disposed on a pipe wall proximate to the first and second ends to define a first and a second overflow hole sections;

a middle pipe, being a conical pipe and having a first end with a diameter larger than that of a second end, and an overflow hole disposed on the pipe wall, and the middle pipe is sheathed onto the first overflow hole section of the internal pipe, and the first end of the middle pipe faces the first end of the internal pipe, and the second end of the middle pipe is fixed onto the pipe wall of the internal pipe, and a increasingly reduced volume overflow space is defined between the conical shape of the middle pipe and the internal pipe;

an external pipe, being sheathed onto the internal pipe and the middle pipe, and both ends of the external pope being fixed onto the exterior of the internal pipe by binding the pipe wall, such that one end seals the foregoing overflow space and the other end includes a second overflow hole section of the internal pipe; and a restrictor, having a first end and a second end, and the first end has a diameter larger than that of the second end, and streamline internal and external profiles are disposed along the first and second ends, and the first end of the restrictor is coupled onto the internal pipe wall and the second end faces the second end of the internal pipe.

DETAILED DESCRIPTION OF THE PREFERRED EMBODIMENTS

Figure 1:
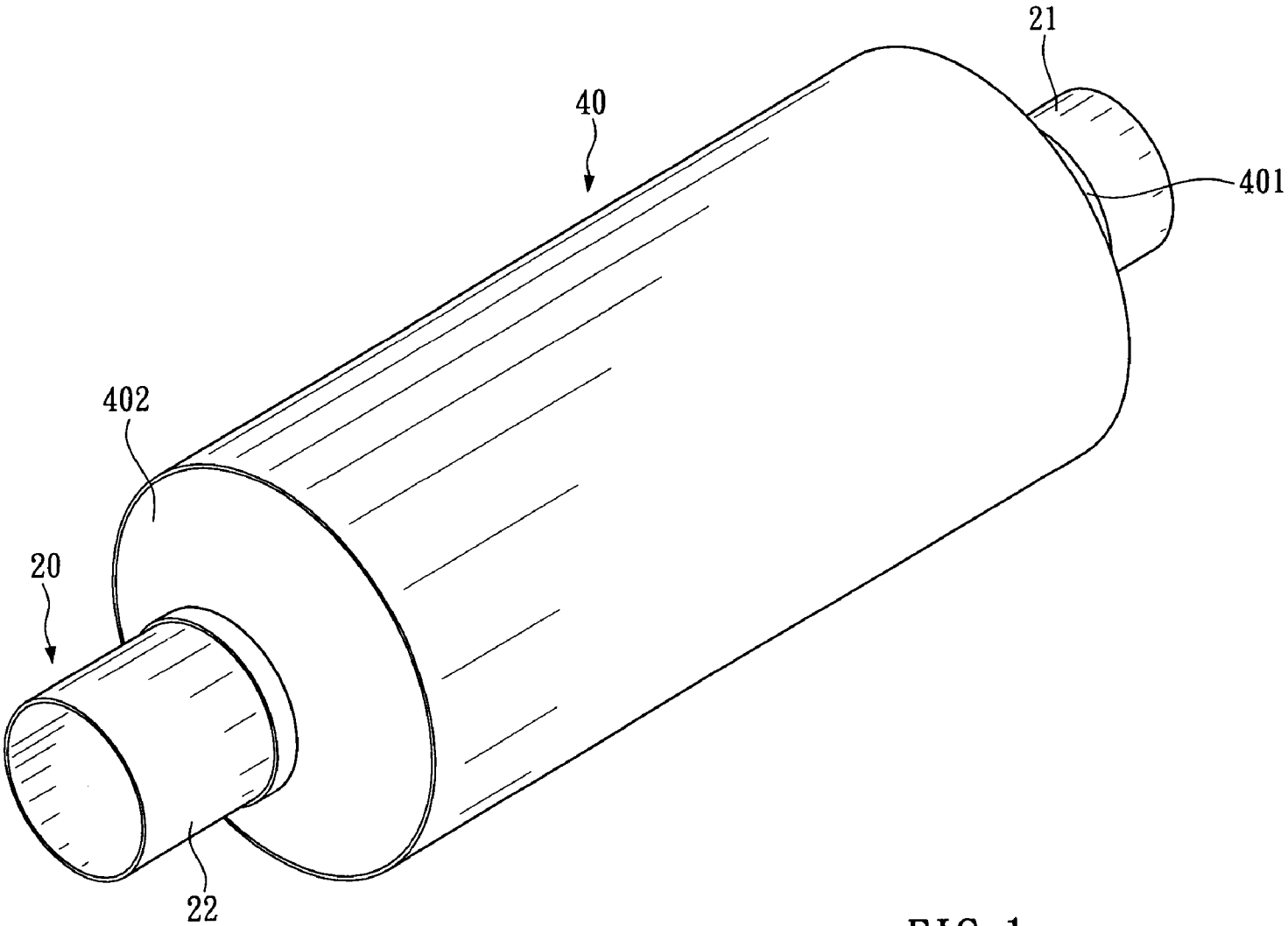
FIG. 1 is a perspective view of the present invention.
Figure 2:
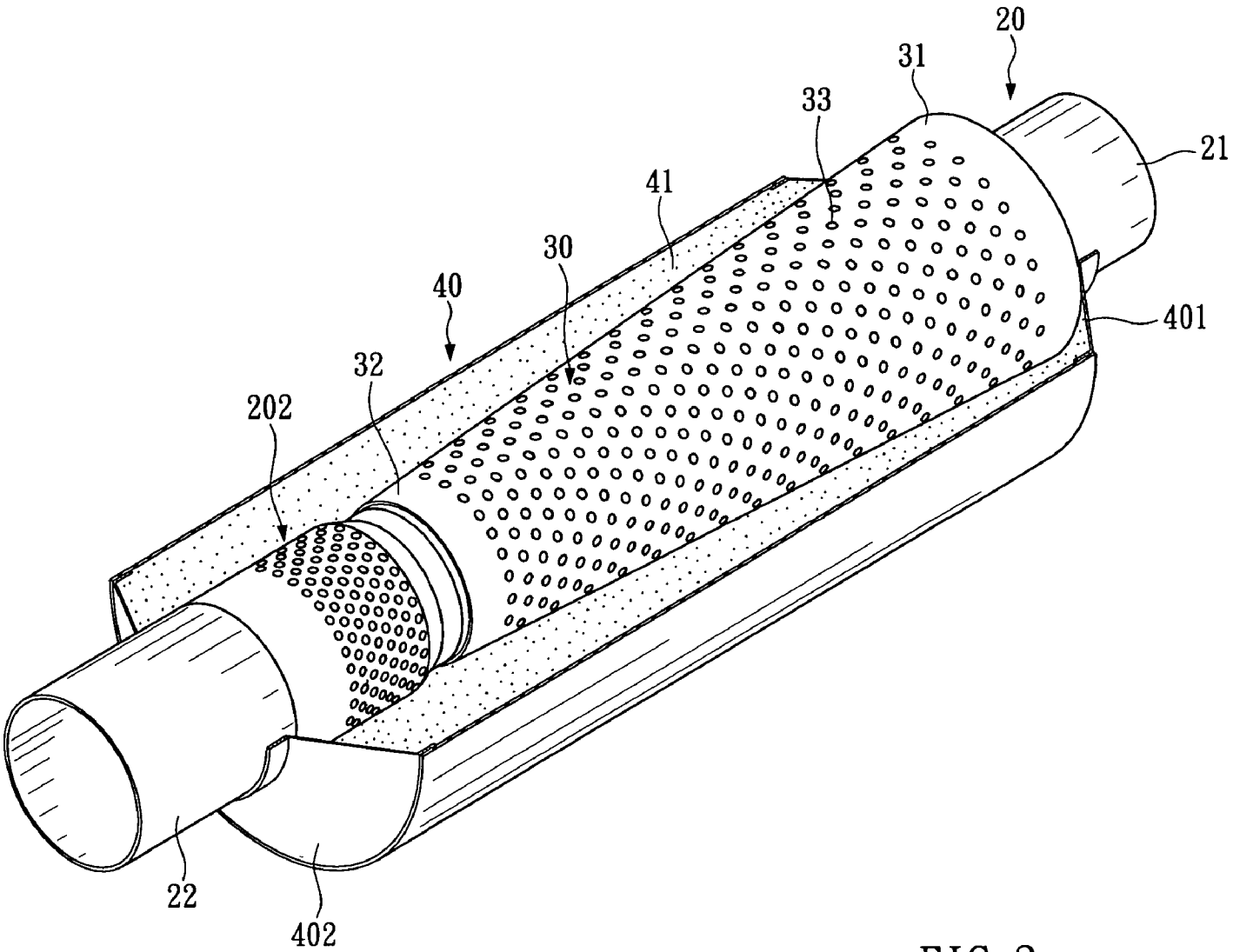
FIG. 2 is a cross-sectional view of the present invention.
Figure 3:
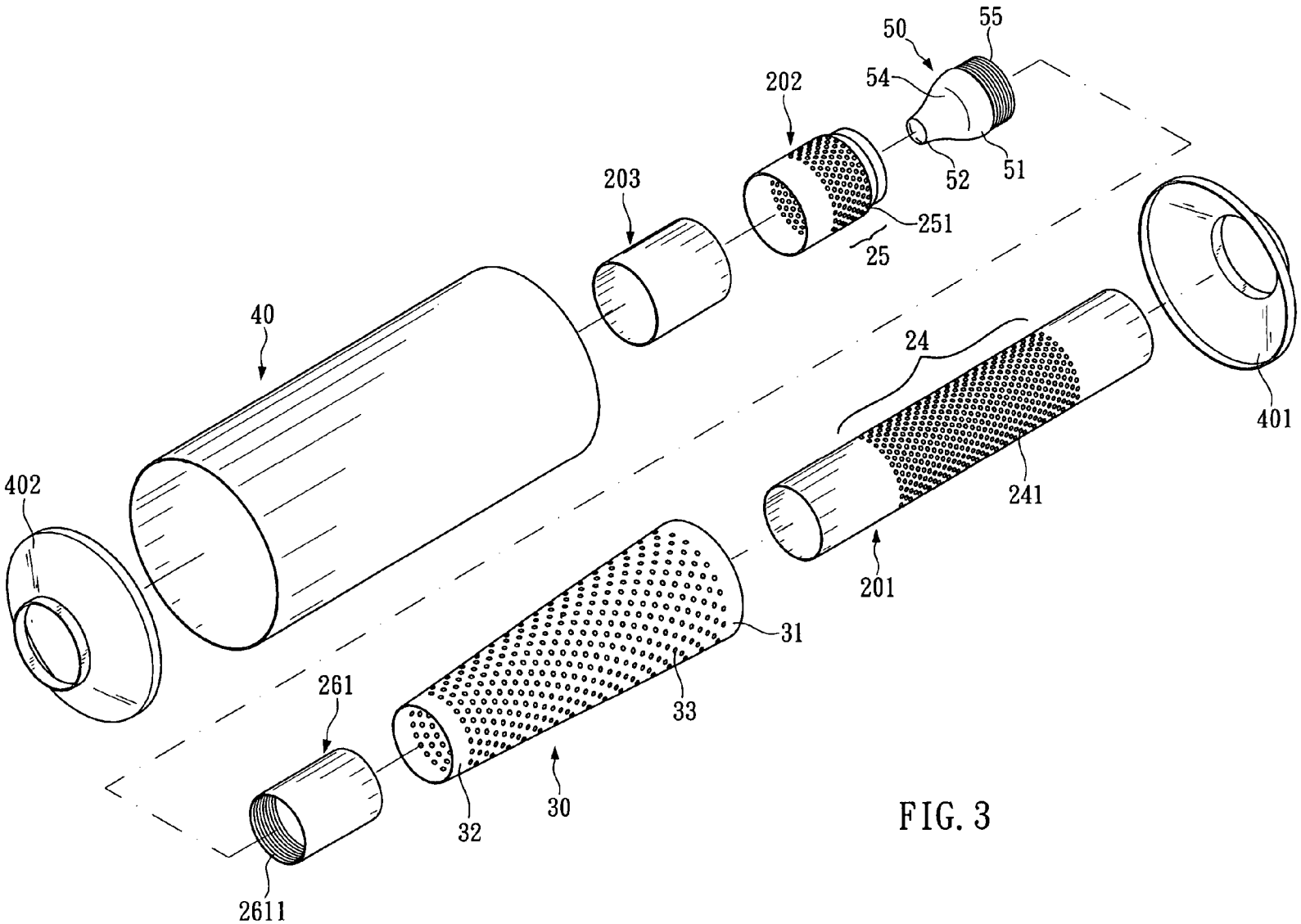
FIG. 3 is an exploded view of the present invention.
Figure 4:
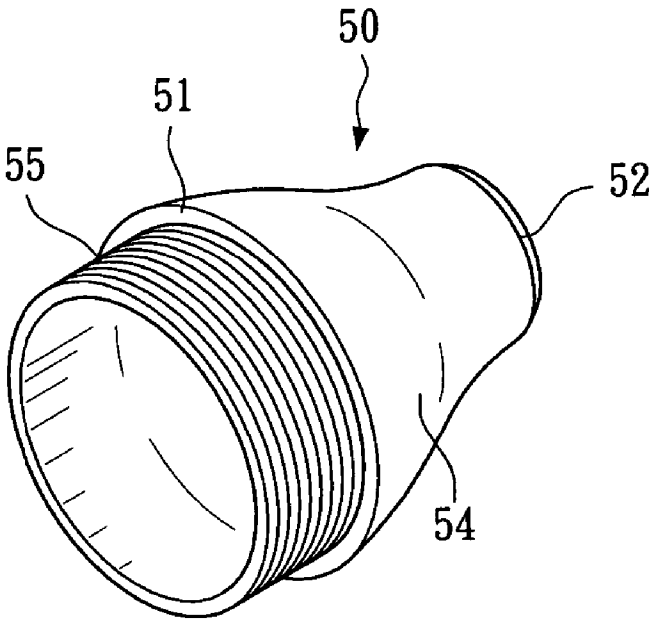
FIG. 4 is a perspective view of a restrictor of the present invention.
Figure 5:
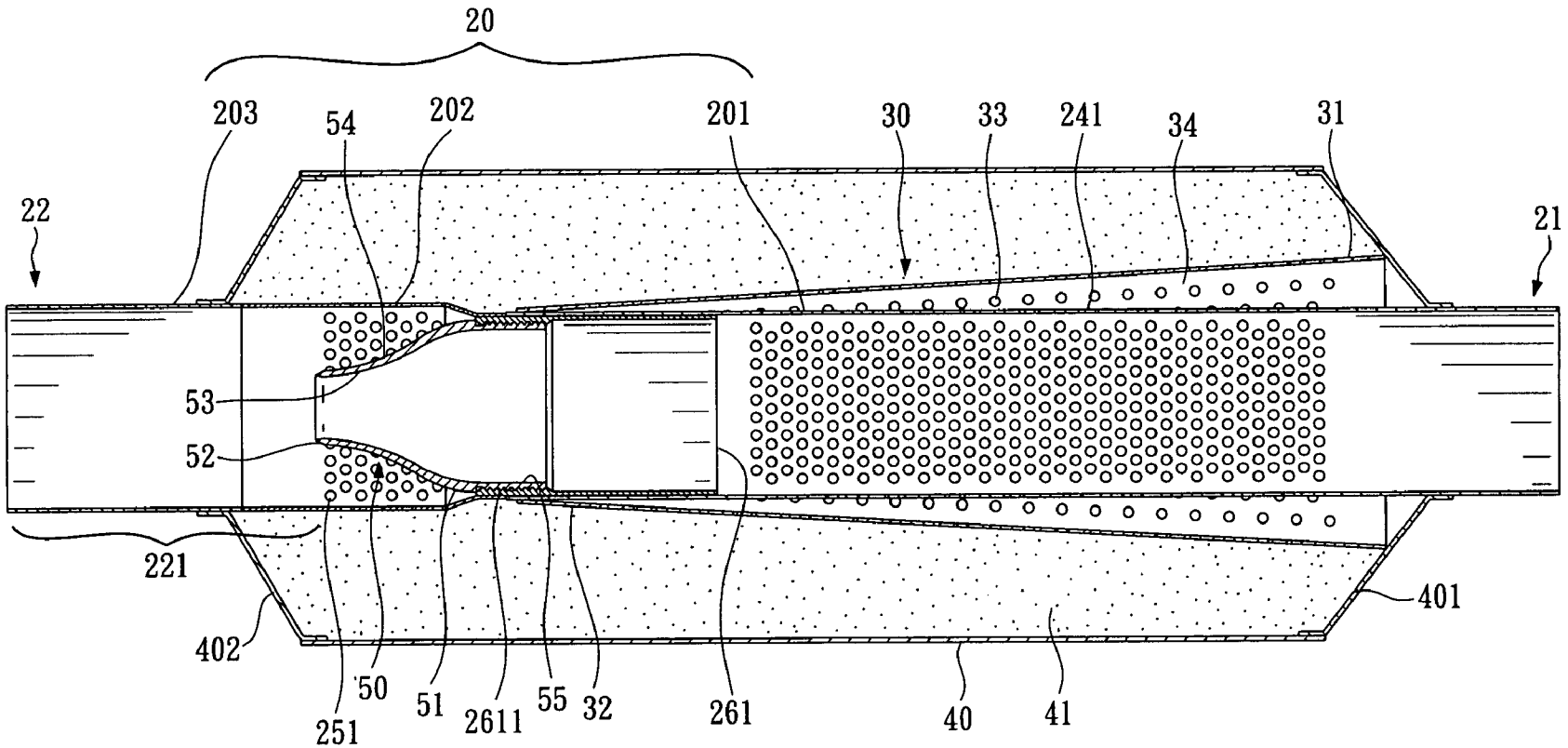
FIG. 5 is a cross-sectional view of the present invention.

The exhaust pipe in accordance with the present invention comprises:

an internal pipe 20, as shown in FIGS. 3 and 5, being comprised of a first pipe section 201, a second pipe section 202 and a third pipe section 203 coaxially coupled with each other, and the internal pipe 20 comprising linearly corresponding first end 21 and second end 22, a plurality of overflow holes 241, 251 disposed on the pipe walls proximate to the first end 21 and the second end 22 to define a first and a second overflow hole sections 24, 25, and a connecting pipe 261 disposed at the intersection of the first and second pipe sections 201, 202 as shown in the figure, and the connecting pipe 261 including a thread section 2611 at a pipe end corresponding to the second end 22 of the internal pipe 20;

a middle pipe 30, as shown in FIGS. 2, 3 and 5, being a conical pipe and having a first end 31 with a diameter larger than that of the second end 32, an overflow hole 33 disposed on the pipe wall, and the middle pipe 30 is sheathed onto the first overflow hole section 24 of the internal pipe 20, and the first end 31 of the middle pipe 30 faces the first end 21 of the internal pipe 20, and the second end 32 of the middle pipe 30 is fixed onto the outside of the pipe wall of the internal pipe 20, and an overflow space 34 with an increasingly reduced volume is defined between the conical structure of the middle pipe 30 and the internal pipe 20;

an external pipe 40, as shown in FIGS. 1, 2, 3 and 5, being sheathed onto the internal pipe 20 and the middle pipe 30, and having both ends respectively fixed onto the outside of the internal pipe 20 by a binding ring pipe 401. 402, such that one end of the external pipe 40 seals the overflow space 34 and the other end includes the second overflow hole section 25 of the internal pipe 20, and a sound silence material 41 (such as sound silence cotton) is filled between the external pipe 40, the internal pipe 20, and the middle pipe 30; and a restrictor 50, as shown in FIGS. 3, 4 and 5, having a first end 51 and a second end 52, and the diameter of the first end 51 is larger than that of the second end 52, and streamline external and internal profiles 53, 54 are disposed along the first and second ends 51, 52, and a connecting section 55 is extended coaxially from the first end 51 as shown in the figure, and the connecting section 55 includes an external thread section, and the external thread section of the connecting section 55 is coupled with the internal thread section 2611 of the connecting pipe 261.

The foregoing exhaust pipe assembly uses the first end 21 of the internal pipe 20 to fix the end of the exhaust pipe by a prior art for collecting the waste gas discharged from an automobile.

Figure 6:
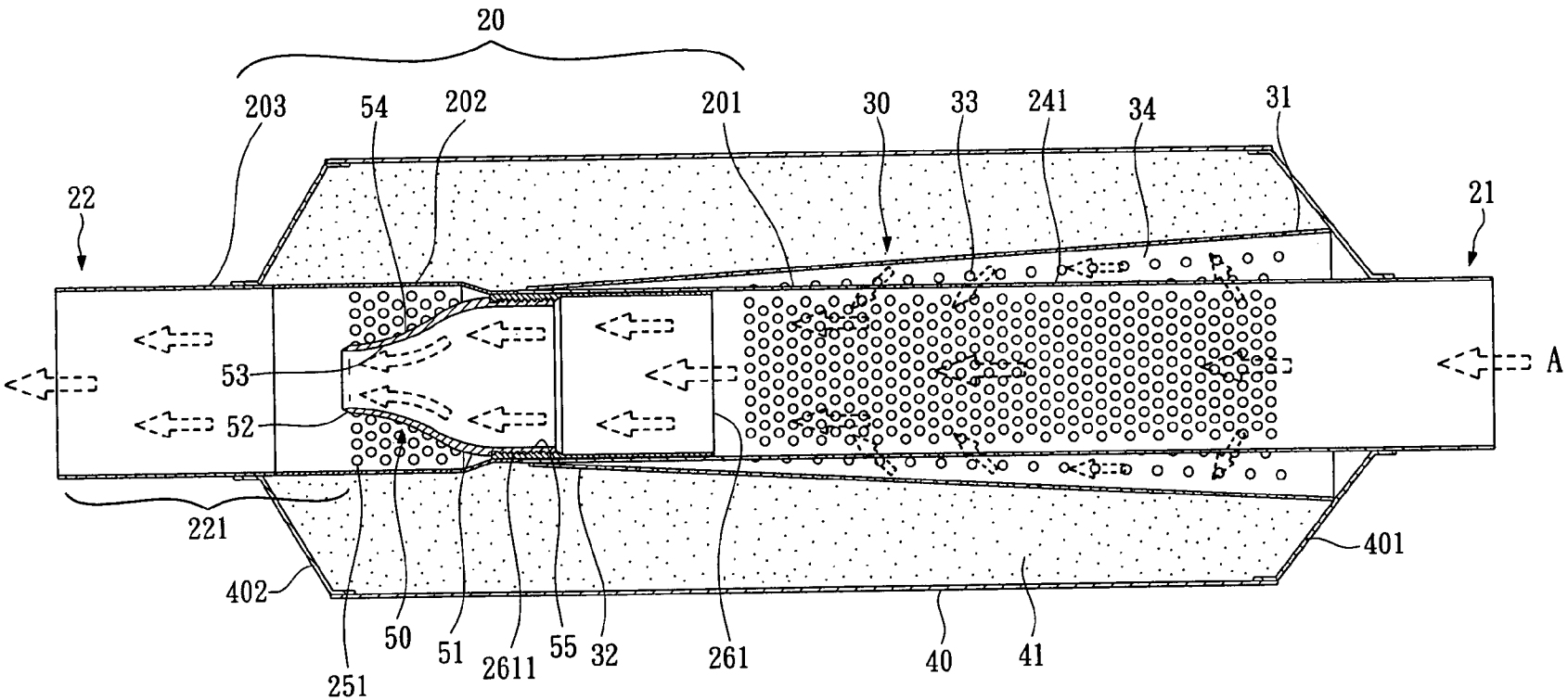
FIG. 6 is a cross-sectional view of the waste gas movement when an engine is running at a low speed according to the present invention.

In FIG. 6, when the engine of an automobile is running at a low speed, the exhaustion capacity is smaller and the airflow is slower. Air enters into the internal pipe 20 in the direction indicated by the arrow A in FIG. 6. Due to the streamline tapered internal profile 53 of the restrictor 50, waste gases produce a pressure when passing through the restrictor 50. The pressure of the waste gases assists the torque output when the engine is running at a low speed. When the pressure of the discharged gases is produced, some of the gases will overflow into an overflow space 34 through an overflow hole 241 of a first overflow hole section 24 of the internal pipe 20. However, the overflow space 34 is tapered along the direction of the airflow, and the pressure is increased from one end to the other end. Therefore, the waste gas will flow from a tapered end of the overflow space 34 back into the internal pipe 20 through the overflow hole 241 of the internal pipe 20. Since the middle pipe 30 is in a conical shape and tapered towards the direction of the airflow, the noise of the discharged gas can be suppressed. The exhaust pipe of the present invention can effectively lower the noise of the discharged gas when the engine is running at a low speed.

Figure 7:
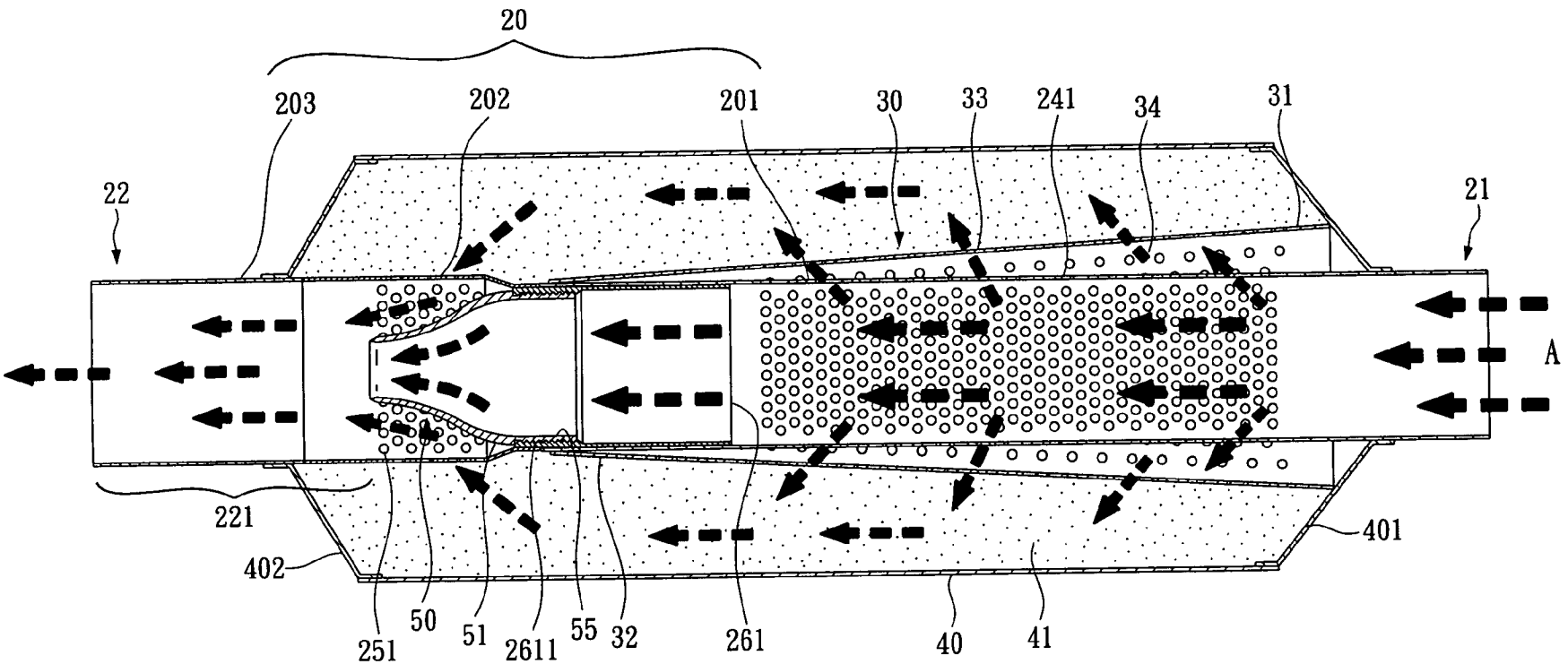
FIG. 7 is a cross-sectional view of the waste gas movement when an engine is running at a high speed according to the present invention.

Referring to FIG. 7, the exhaustion capacity and the gas flow become larger when the engine is running from a slow speed to a high speed, and thus more waste gas flows into the internal pipe 20 in the direction indicated by the arrow A. The overload of waste gas will be overflowed from an overflow hole 241 of a first overflow hole section 24 of the internal pipe 20 to the overflow space 34, and the waste gas in the overflow space 34 further enters into a sound silence material 41 through the overflow hole 33. The waste gas in the sound silence material 41 flows back into the internal pipe 20 through the overflow hole 251 of the second overflow hole section 25 of the internal pipe 20 and then the waste gas is discharged to the outside. It is worth to note that when there is a large quantity of waste gas in the internal pipe 20 to increase the pressure inside the pipe, some of the waste gas will automatically be discharged from a second end 22 of the internal pipe 20 through the overflow hole 241 of the internal pipe 20, the overflow space 34, the overflow hole 33 of the middle pipe 30, the sound silence material 41, and the overflow hole 251 of the second overflow hole section 25 of the internal pipe 20. This process is an automatic split flow that speeds up the discharge of waste gas. Since the pressure of the overflow space 34 is larger in this process and the waste gas will flow back from the foregoing direction, therefore a large quantity of fast waste gas can be discharged successfully by the exhaust pipe of the present invention, so as to maximize the engine operating performance. When the waste gas flows back into the internal pipe 20 from the overflow hole 251 of the second overflow hole section 25 of the internal pipe 20, the streamline tapered external profile 54 of the restrictor 50 will not constitute an obstacle to the flow of the waste gas, and it even guides and discharges the waste gas towards the direction of an outlet. Since the middle pipe 30 is in a conical shape and tapered in the direction of the airflow, therefore the noise produced by the discharged gas of different frequencies can be suppressed. With the sound silence material 41, the noises of the high-speed flow can be absorbed. Therefore, the noise of the discharged gas can be lowered by the exhaust pipe of the present invention when the engine is running at a high speed.

Referring to FIGS. 6 and 7, the overflow holes 251 of the foregoing second pipe section 202 (which is also the second overflow hole section 25) are distributed at the positions corresponding to the restrictor 50. In other words, there is no overflow hole 251 at the position beyond the second pipe section 202 of the restrictor 50. The main effect is to create a hole free pipe section 221 of the second end 22 of the internal pipe 20, and the hole free pipe wall can suppress the sound transmission of the noise of the discharged gas. The second effect is to make use of the hole free pipe section 221 to reduce the loss of the sound silence cotton 41 since the sound silence cotton 41 is made of fiberglass that has the thermal resisting, moisture resisting, incombustibility, chemical corrosiveness resisting, mold resisting, heatproof, soundproof, and insulating features. However, the fiberglass has its weaknesses such as its fragility and poor wear resistance. If a large quantity of waste gas in the exhaust pipe of the present invention passes through the sound silence cotton 41 at a high speed, the sound silence cotton 41 will have a slight burning phenomenon caused by the collisions of a large quantity of high-temperature waste gas. Such burning phenomenon may cause the sound silence cotton 41 to fall off, and a small part of the burned sound silence cotton will together with the waste gas may enter into the internal pipe 20 through the overflow hole 251 of the second pipe section 202. To prevent excessive losses of the sound silence cotton in the second pipe section 202 while achieving the purpose of discharging a large quantity of waste gas by split flows, the inventor of the present invention restricts the overflow holes 251 of the second pipe section 202 to the position of the restrictor 50.

A user may selectively use or remove the foregoing restrictor 50, since the restrictor 50 comes with a thread connecting section 55 to be connected to a connecting pipe 261 of the internal pipe 20. Such arrangement makes the assembling and removal very easy.

After the restrictor 50 is removed, the internal pipe 20 is used to define a longer distance of the gas passage, so that a pressure will be produced when the waste gas passes through the internal pipe 20. If the restrictor 50 is installed, the pressure will be larger and the time for forming the pressure will become shorter.

A restrictor 50 with different diameters can be installed to the foregoing exhaust pipe of a fixed specification to fit different automobiles with different engine outputs. Thus, the present invention provides a solution of changing the exhaustion capacity of an exhaust pipe.

In summation of the description above, the exhaust pipe of the present invention can produce an appropriate gas discharge pressure when the engine is running at a low speed, so at to assist the low-speed torque output, and the exhaust pipe can automatically discharge the waste gas in split flows when the engine is running at a high speed. Therefore, the present invention can meet both of the high-speed and low-speed requirements. In addition, the internal pipe 20 can isolate the noise made by the airflow of the waste gas by means of the overflow space 34, the sound silence space 41, and the external pipe 40. The first end 21 and the second end 22 of the internal pipe 20 are free of holes, therefore the first end 21 and the second end 22 can further suppress the noise of the waste gas. Overall speaking, the exhaust pipe of the present invention produces very little noise for discharging the waste gas.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An automobile exhaust pipe assembly, comprising:

an internal pipe, having linearly corresponding first end and second end, a plurality of overflow holes disposed on a pipe wall proximate to said first end and said second end to define a first and a second overflow hole sections;

a middle pipe, being a conical pipe and having a first end with a diameter larger than that of a second end, an overflow hole disposed on said pipe wall, and said middle pipe is sheathed onto said first overflow hole section of said internal pipe, and said second end of said middle pipe is fixed onto the outside of said pipe wall of said internal pipe, and an overflow space with an increasingly reduced volume is defined between the conical structure of said middle pipe and said internal pipe;

an external pipe, being sheathed onto said internal pipe and said middle pipe, and having both ends respectively fixed onto the one end of said external pipe seals sand overflow space and the other end includes said second overflow hole section of said internal pipe; and a restrictor, having a first end and a second end, and the diameter of said first end is larger than that of said second end, and external and internal streamline profiles disposed along said first and second ends, and said first end of said restrictor is coupled to said internal pipe wall of said internal pipe and said second end faces said second end of said internal pipe wherein said internal pipe is comprised of a first pipe section, a second pipe section and a third pipe section coaxially coupled with each other further comprising a connecting pipe disposed at the intersection of said first and second pipe sections for connecting a first end of said restrictor.

2. The automobile exhaust pipe assembly of claim 1, wherein said connecting pipe includes an internal thread section disposed at an end corresponding to said second end of said internal pipe, and said first end of said restrictor has an external thread section.

3. An automobile exhaust pipe assembly, comprising:

an internal pipe, having linearly corresponding first end and second end, a plurality of overflow holes disposed on a pipe wall proximate to said first end and said second end to define a first and a second overflow hole sections;

a middle pipe, being a conical pipe and having a first end with a diameter larger than that of a second end, an overflow hole disposed on said pipe wall, and said middle pipe is sheathed onto said first overflow hole section of said internal pipe, and said first end of said middle pipe faces said first end of said internal pipe, and said second end of said middle pipe is fixed onto the outside of said pipe wall of said internal pipe, and an overflow space with an increasingly reduced volume is defined between the conical structure of said middle pipe and said internal pipe; and an external pipe, being sheathed onto said internal pipe and said middle pipe, and having both ends respectively fixed onto the outside of the internal pipe by a binding ring pipe, such that one end of said external pipe seals said overflow space and the other end includes said second overflow hole section of said internal pipe wherein said internal pipe is comprised of a first pipe section, a second pipe section and a third pipe section coaxially coupled with each other further comprising a connecting pipe disposed at the intersection of said first and second pipe sections fro connecting a first end of said restrictor.

4. The automobile exhaust pipe assembly of claim 3 wherein said connecting pipe includes an internal thread section disposed at an end corresponding to said second end of said internal pipe, and said first end of said restrictor has an external thread section.

* * * * *